United States Patent [19]

Van Gasse

[11] 4,076,875

[45] Feb. 28, 1978

[54] ORNAMENTAL DESIGN

[75] Inventor: Rene L. E. Van Gasse, Opglabbeek, Belgium

[73] Assignee: All Decostone, N.V., Opglabbeek, Belgium

[21] Appl. No.: 654,235

[22] Filed: Feb. 2, 1976

[30] Foreign Application Priority Data

Feb. 7, 1975 Netherlands ..... 7501450

[51] Int. Cl.[2] ..... B32B 3/10; B32B 7/02

[52] U.S. Cl. ..... 428/44; 52/384; 264/DIG. 31; 428/174; 428/187; 428/213

[58] Field of Search ..... 428/44–52, 428/131, 134, 174, 187, 53, 54, 213; 52/379, 384, 387, 389, 392; 264/DIG. 31, 291, 293

[56] References Cited

U.S. PATENT DOCUMENTS

| | | | |
|---|---|---|---|
| 3,500,606 | 3/1970 | Wharmby | 52/392 |
| 3,657,852 | 4/1972 | Worthington et al. | 52/392 |

*Primary Examiner*—George F. Lesmes
*Assistant Examiner*—P. J. Thibodeau
*Attorney, Agent, or Firm*—Cushman, Darby & Cushman

[57] ABSTRACT

Ornamental element consisting of a number of tile-shaped parts which are joined, with interspaces, on the non-exposed side to form a bond. The adjacent tile-shaped parts are given a fixed relative bond by one or more joining strips, which form one whole with the tile-shaped parts, and consist preferably of one and the same material, and are moulded in one action.

The joining strips are made as bridgings, the height of the opening of which plus the tile thickness is equal to or larger than the width of the joint between the tile shaped parts; the thickness if equal to or smaller than the width of the joint. The bridge-shaped parts have a form which allows release from a mould.

The ornamental element consists of a thermosetting agent, for example of an unsaturated polyester with fillers or a ceramic material.

13 Claims, 4 Drawing Figures

ORNAMENTAL DESIGN

Figure 1:
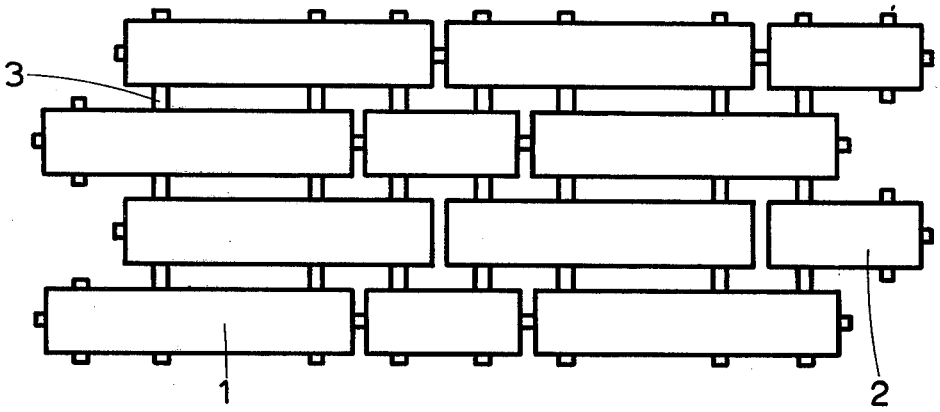

The invention relates to an ornamental element consisting of a number of tile-shaped parts which are joined, with interspaces, on the non-exposed side to form a bond.

Ornamental elements arranged in the above-mentioned way are known. A number of tiles are glued by their back to a gauze to form a bond. These tiles, which are joined to form 'small mats', can be fixed, together, to a base with use of a suitable adhesive (glueing paste or cement mortar). Wall-tilting, particularly in the case of small tiles (mosaic), can be carried out rapidly in this manner. Also other adhesives are known, for instance according to the German Utility Pat. No. 7,216,862 or the German Patent Specification 2,301,169.

The tile mats and the other means mentioned involve certain drawbacks, viz. one or more of the following:

1. the mats are less suitable for application with relatively heavy tiles;
2. fabrication of the mats is still a labor-intensive, or a complex matter;
3. adhesion to the base is moderate - especially if plastic tiles on concrete are used - and less or not suitable for outdoor work under varying weather conditions;
4. they can hardly be fixed in one action to the surface of concrete elements during the fabrication thereof;
5. as a rule, it is difficult to apply the mats in a flat plane.

The purpose of the invention is to provide ornamental elements consisting of a number of tile-shaped parts joined, with interspaces, to form a bond, which elements do not show the above-mentioned drawbacks. The purpose particularly aimed at is provision of ornamental elements which can be made in one action and which are suitable to form a whole with concrete elements and to be joined therewith already during the fabrication of the concrete elements.

According to the invention this is achieved if adjacent tile-shaped parts are given a fixed relative bond by one or more joining strips. These form one whole with the tile-shaped parts. They preferably consist of one and the same material.

If the tile-shaped parts are moulded from a plastic, like a suitable thermosetting agent, both they and the strips are moulded in one action.

The joining strips are, by preference, made as bridgings in order that, particularly when the ornamental elements are cast into concrete parts, sound anchoring is obtained.

The height of the opening of the bridging plus the tile thickness is equal to or larger than the width of the joint between the tile-shaped parts; the thickness if equal to or smaller than the width of the joint. Of course, the shape thereof should be such that the bridgings can be easily released from the mould together with the tile-shaped parts.

It is noted that adhesion of a laminate to an inorganic mass, like concrete, is known from the Netherlands Pat. application 7,305,808. To this end, a lattice is attached to the laminate, on which, subsequently, the concrete mortar is applied. Contrary to the bridgings, the lattice is to be attached to the laminate in a separate action. If it is applied for many tile-shaped parts at once, the same drawbacks are involved as those attached to the mats mentioned in the introduction.

The number of bridgings connecting the tile-shaped parts depends entirely on the shape and the dimensions of these parts. If the tile-shaped parts should be, for instance, ornamental strips of 5 × 20 cm, one bridging which connects the short sides of adjacent ornamental strips and two which connect the long sides of adjacent ornamental strips suffice.

Suitable materials for manufacture of the ornamental elements according to the invention are all mouldable plastics. It will be tried, by incorporation of inorganic materials, to make the thermal expansion coefficient as much as possible equal to that of the base. Highly suitable as material are thermosetting agents, like moulding masses of unsaturated polyester resin. These masses usually consist of three ingredients, notably a fibrous reinforcing material, a filler material and the unsaturated polyester resin. The fibrous reinforcing material may consist of mineral, fibrous material, of non-deteriorating plastic or vegetable fibers, or of a combination of these kinds of fibers. The filler material will mainly consist of minerals and may be powdery, granular, crystal-shaped or laminar, or consist of combinations of these substances. Many of these moulding masses are masses known in trade as, among others, bulk moulding compound (BMC), dough moulding compound (DMC), or sheet moulding compound (SMC), also called 'prepeg', i.e., pre-impregnated glass mat. The composition of these products is, chiefly, identical. During the moulding, a decorative effect may be imparted to these masses by applying the process mentioned in the Netherlands Pat. application 7,305,807.

However, the ornamental elements can also be prepared from other mouldable plastics. They can even be made from ceramic material, in which the appropriate, known moulding and burning techniques are applied.

If the ornamental elements are incorporated in concrete parts, the elements are laid in a relative bond, with the exposed side facing downwards, on the bottom of a concrete casting matrix. The concrete mortar is poured onto them. The mortar penetrates underneath the bridge-shaped parts and between the joints. The concrete element is allowed to harden partially and is subsequently taken out of the matrix. Any cement mortar that has penetrated between the bottom of the matrix and the exposed side of the ornamental elements is sprayed away with a high-pressure water jet, in which, if required, also a slightly recessed joint can be obtained between the tile-shaped parts. If necessary, the bottom of the matrix is provided with a thin layer of cement retarder, as is known from the fabrication of elements having a surface of washed gravel. Concrete elements with one or more faces being provided with cast-in ornamental elements according to the invention are highly suitable for outdoor work. The tile-shaped parts render the exposed side quite downpour-tight; through the joints on the other hand some water diffusion from the inside out is possible. Concrete building elements one or more faces of which are provided with ornamental elements according to the invention are considered as being covered by the invention.

The ornamental elements may also be used in combination with materials other than concrete, for instance in combination with resin-bound sand elements, amongst others as described in the Netherlands Pat. application 7,313,830. Also a combination with a base of foamed, whether or not reinforced, plastic, such as polyurethane foam and other foams, is possible without further measures. These building elements, too, form part of the invention.

Figure 2:
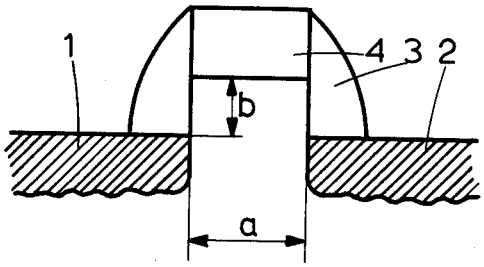
Figure 3:
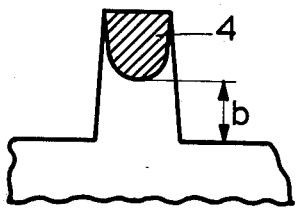

The invention is elucidated by means of a drawing. This shows, non-limiting, by:

FIG. 1 a front view of an ornamental element;

FIG. 2 a front view of a bridging model;

FIG. 3 a cross-section of the bridging, and by

Figure 4:
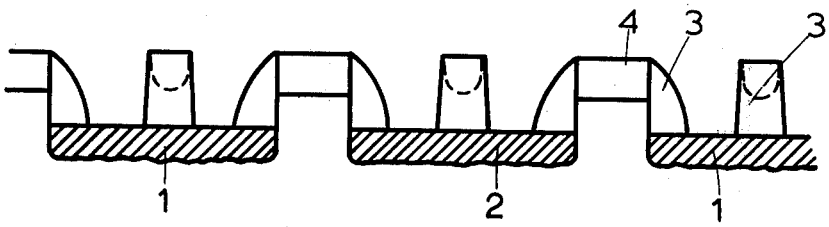

FIG. 4 a side view of part of an element.

In FIG. 1, 1 and 2 indicate tiles of different sizes, which, on the non-exposed side, are relatively connected by bridgings 3 of the same material as the tiles to form a bond. The distance between the tiles corresponds to the normal joint width. The tiles with bridgings are obtained by moulding in a mould in one action. In FIG. 2, a. indicates the joint width between the tiles and b. the height of the opening of the bridging which, together with the tile thickness, is equal to or larger than the joint width a. The thickness of the bridging is equal to or smaller than the joint width. The section 4 of the bridging 3 is curved on the side facing the tiles, so that the concrete mortar is more accessible. As indicated in FIG. 3, the rising sides of the bridgings are slightly conical, which improves their release from the mould. For the same purpose also the edges of the tiles are somewhat conical. A side view of part of an ornamental element is given in FIG. 4, showing, as does FIG. 1, that the tiles are relatively connected by bridgings on both the longitudinal and the short sides.

The edges of separate elements are provided with half bridgings, which may connect with an adjacent element. Adhesion of the edges of the separate elements, as well as a proper relative distance, is ensured thereby.

The tile-shaped parts may be of any shape and size, as called for by local conditions. A rectangular form is not essential. The surface of the exposed side may be provided in a known way with any, arbitrary, relief or design. In addition to the above-mentioned special application, there are other possibilities for applying the ornamental elements according to the invention. They can be applied to floors, walls or ceilings as elements which may or may not be wholly or partly pervious to light, air or water. As a rule, the aesthetical character may be utilized.

What is claimed is:

1. An ornamental element comprised of a plurality of spaced-apart tile members, each of said tile members having a front exposed face, a rear non-exposed face and a predetermined thickness, said tile members being joined to adjacent tile members and spaced therefrom by a first predetermined distance by one or more bridging members attached to and extending away from the rear non-exposed face of adjacent tiles being joined, each of said bridging members having a thickness which is equal to or smaller than said first predetermined distance and includes a leg member fixedly attached to the rear non-exposed face of each of the two adjacent tiles being joined and a bridging section extending threbetween fixedly attached to each of said leg members said bridging section being spaced away from said rear non-exposed face by a second predetermined distance so as to form an opening between said bridging section and said rear non-exposed face wherein the height of the opening as defined by said second predetermined distance together with the thickness of the tiles is equal to or larger than said first predetermined distance.

2. An ornamental element as in claim 1 wherein said tile members and said bridging members are comprised of the same material.

3. An ornamental element as in claim 2 wherein said material is a thermosetting material.

4. An ornamental element as in claim 2 wherein said material is an unsaturated polyester resin with fillers.

5. An ornamental element as in claim 2 wherein said material is a mouldable plastic.

6. An ornamental element as in claim 2 wherein said material is comprised of a ceramic material.

7. An ornamental element as in claim 1 wherein that portion of said bridging section facing said rear non-exposed face is curved.

8. An ornamental element as in claim 1 wherein said bridge members are shaped so as to be easily releasable from a forming mould.

9. An ornamental element as in claim 8 wherein the rising sides of said leg members are provided with a slightly conical shape.

10. An ornamental element as in claim 1 wherein said tile members and said bridging members comprise a one-piece structure.

11. A building element comprised of a base material, an ornamental element comprising a plurality of spaced-apart tile members, each of said tile members having a front exposed face, a rear non-exposed face and a predetermined thickness, said tile members being joined to adjacent tile members and spaced therefrom by a first predetermined distance by one or more bridging members attached to and extending away from the rear non-exposed face of adjacent tiles being joined, each of said bridging members having a thickness which is equal to or smaller than said first predetermined distance and includes a leg member fixedly attached to the rear non-exposed face of each of the two adjacent tiles being joined and a bridging section fixedly attached to each of said leg members said bridging section being spaced away from said rear non-exposed face by a second predetermined distance so as to form an opening between said bridging section and said rear non-exposed face, said ornamental element being embedded in said base material so that said rear non-exposed face is in contact with said base material, and said front exposed face remains exposed, said base material being formed around said bridging members and between adjacent tile members so as to securely retain said ornamental element wherein the height of the opening as defined by said second predetermined distance together with the thickness of the tiles is equal to or larger than said first predetermined distance.

12. A building element as in claim 11 wherein said ornamental element is comprised of a material having a thermal expansion coefficient substantially equal to said base material.

13. An ornamental tile-shaped part suitable for being embedded in a base material or joined to similar tile-shaped parts, each of said parts having a front face, a rear face, a plurality of sides and a predetermined thickness, one or more leg members being fixedly attached to said rear face adjacent the side edge of said rear face along each of said plurality of sides and a bridging section fixedly attached to each said leg member and spaced vertically above said rear face a first predetermined distance, said bridging section extending away from said tile-shaped part and beyond the sides thereof by a second predetermined distance whereby when said tile-shaped parts are joined together in a base material bridging sections of adjacent tile-shaped parts will connect to bridging sections of adjacent tile-shaped parts thereby spacing apart said tile-shaped parts by a third predetermined distance with said first predetermined distance together with the thickness of said tile-shaped parts being equal to or larger than said third predetermined distance.

* * * * *